US009666335B2

(12) United States Patent
Rupflin et al.

(10) Patent No.: US 9,666,335 B2
(45) Date of Patent: May 30, 2017

(54) MICROWAVE CABLE AND METHOD FOR PRODUCING AND USING SUCH A MICROWAVE CABLE

(71) Applicant: HUBER+SUHNER AG, Herisau (CH)

(72) Inventors: Michael Rupflin, Schänis (CH); Matias Klarer, Gossau (CH)

(73) Assignee: HUBER+SUHNER AG, Herisau (CH)

( * ) Notice: Subject to any disclaimer, the term of this patent is extended or adjusted under 35 U.S.C. 154(b) by 0 days.

(21) Appl. No.: 14/438,829

(22) PCT Filed: Oct. 17, 2013

(86) PCT No.: PCT/EP2013/071774
§ 371 (c)(1),
(2) Date: Apr. 27, 2015

(87) PCT Pub. No.: WO2014/063994
PCT Pub. Date: May 1, 2014

(65) Prior Publication Data

US 2015/0287501 A1 Oct. 8, 2015

(30) Foreign Application Priority Data

Oct. 26, 2012 (CH) ..... 2120/12

(51) Int. Cl.
*H01B 7/00* (2006.01)
*H01B 11/18* (2006.01)
(Continued)

(52) U.S. Cl.
CPC ..... *H01B 11/183* (2013.01); *H01B 3/307* (2013.01); *H01B 7/30* (2013.01); *H01B 13/016* (2013.01); *H01P 3/06* (2013.01); *Y10T 29/49123* (2015.01)

(58) Field of Classification Search
CPC ..... H01B 7/226; H01B 11/183
(Continued)

(56) References Cited

U.S. PATENT DOCUMENTS 2,447,168 A 8/1948 Dean et al.
2,691,698 A 10/1954 Schmidt
(Continued)

FOREIGN PATENT DOCUMENTS

CN 201233756 Y 5/2009
DE 618646 9/1935
(Continued)

OTHER PUBLICATIONS

Japanese Patent Office (JPO), Office Action—Notice of Reasons for Rejection, Jul. 5, 2016, Japanese Patent Application P2015-538385 (5 pages).
(Continued)

*Primary Examiner* — Chau N Nguyen
(74) *Attorney, Agent, or Firm* — Pauley Erickson & Kottis

(57) ABSTRACT

A microwave cable (10), intended for a frequency range from 0 Hz up to at least a few 10 GHz, comprises a central inner conductor (11), a dielectric (12) concentrically surrounding the inner conductor, an outer conductor (13, 14) concentrically enclosing the dielectric (12), and a sheathing concentrically enclosing the microwave cable (10) externally. Stable electrical and mechanical properties, particularly when making up cables, are achieved in that the outer conductor has two electrically conducting bands (13, 14) wound over each other, in that the bands (13, 14) are each wound in an overlapping manner and in that the bands (13, 14) are wound progressively in opposite directions.

19 Claims, 3 Drawing Sheets

(51) Int. Cl.

| | |
|---|---|
| ***H01P 3/06*** | (2006.01) |
| ***H01B 3/30*** | (2006.01) |
| ***H01B 7/30*** | (2006.01) |
| ***H01B 13/016*** | (2006.01) |

(58) Field of Classification Search
USPC ..... 174/106 R, 109
See application file for complete search history.

(56) References Cited

U.S. PATENT DOCUMENTS

| | | | | | |
|---|---|---|---|---|---|
| 3,340,353 | A * | 9/1967 | Mildner | H01B 7/202 | 156/54 |
| 3,588,317 | A * | 6/1971 | Hutchins, Jr. | H01B 11/1025 | 174/106 R |
| 3,643,007 | A * | 2/1972 | Roberts | H01B 11/1808 | 174/106 R |
| 3,810,803 | A * | 5/1974 | Karp et al. | B31C 3/00 | 156/190 |
| 3,963,854 | A * | 6/1976 | Fowler | H01B 11/1025 | 174/106 R |
| 4,282,398 | A * | 8/1981 | Solomon | H01B 7/226 | 138/101 |
| 4,283,238 | A * | 8/1981 | Jacquemart | H01R 9/0503 | 156/188 |
| 4,449,013 | A * | 5/1984 | Garshick | H01B 7/2806 | 174/103 |
| 5,214,243 | A | 5/1993 | Johnson | | |
| 5,349,133 | A * | 9/1994 | Rogers | H01B 11/1033 | 174/106 R |
| 5,414,215 | A * | 5/1995 | Dunand | H01B 7/0009 | 174/109 |
| 5,434,354 | A * | 7/1995 | Baker | H01B 11/1091 | 174/106 R |
| 6,201,190 | B1 | 3/2001 | Pope | | |
| 7,021,963 | B2 * | 4/2006 | Feldman | H01R 9/05 | 439/578 |

FOREIGN PATENT DOCUMENTS

| | | | |
|---|---|---|---|
| EP | 0 987 720 | A1 | 3/2000 |
| JP | 62-77816 | U | 5/1987 |
| JP | 2002-515632 | A | 5/2002 |
| JP | 2009-272210 | A | 11/2009 |
| JP | 2011-76860 | A | 4/2011 |
| JP | 2012-169265 | A | 9/2012 |
| WO | WO 2005/069314 | A1 | 7/2005 |
| WO | WO 2009/111895 | A1 | 9/2009 |
| WO | WO 2012/093665 | A1 | 7/2012 |

OTHER PUBLICATIONS

Chinese Patent Office, Second Notification of Examiner's Opinion, Serial No. 2016063002204030, Jul. 5, 2016 (5 pages).

* cited by examiner

MICROWAVE CABLE AND METHOD FOR PRODUCING AND USING SUCH A MICROWAVE CABLE

BACKGROUND OF THE INVENTION

Field of the Invention

The present invention concerns the field of microwave technology. Said invention relates to a microwave cable as claimed in the preamble of claim 1. Said invention further relates to a method for producing said microwave cable, and also to the use of a microwave cable of this kind.

Discussion of Related Art

Cabling technology discloses a large number of solutions in respect of how a cable of this kind, when it comprises inner conductors and outer conductors, can be designed.

Document U.S. Pat. No. 2,691,698 describes, for example, a telephone cable which, in addition to a large number of inner conductors, has two outer conductors which are insulated from one another and which are designed as tapings comprising a metal foil. In this case, the outer conductors are used to separately transmit signals.

Document U.S. Pat. No. 2,447,168 discloses a high-frequency cabling in the case of which two inner conductors are enclosed by a dielectric, and two tapings comprising metallized paper are applied to the dielectric one above the other.

Document U.S. Pat. No. 5,214,243 discloses a coaxial cable having a central inner conductor, a dielectric, a layer of wound PTFE tape which is applied to said dielectric, a metal wire mesh which is applied over said layer of wound PTFE tape, a braiding of polyamide fibers which is applied over said metal wire mesh, and finally two tapings comprising PTFE tape which are wound in opposite directions in an overlapping manner.

Finally, document U.S. Pat. No. 6,201,190 describes a coaxial cable in which the dielectric which surrounds the inner conductor is enclosed by two foil tapes which are situated one above the other. In this case, the foil tapes are in the form of aluminum/polyester/aluminum laminates.

These solutions have the disadvantage, especially in the microwave frequency range at frequencies of 40 GHz and above, that it is not possible to manufacture assembled (coaxial) cables with optimum electrical parameters.

In the case of a tape which is wound once, the insertion loss during bending or twisting is unstable because the windings of the tape shift or loosen. In addition, a (coaxial) plug connector which is fitted to the cable end can be matched to a cable of this kind only to a limited extent because the tape can become loose, and therefore no longer bear tightly, after insulation is stripped from the cable end.

Although it is possible to largely prevent the winding (taping) from becoming detached from a cable end when the tape is wound in an overlapping manner because the end of the tape is fixed by the overlapping at the cable end on which the winding progresses in the cable longitudinal direction, fixing of this kind is not provided at the other cable end, and therefore the taping becomes slightly loose or even detached at said cable end.

This has an adverse effect on RF matching to the plug connector, and the stability of this cable section with loosened tape is also impaired.

SUMMARY OF THE INVENTION

The object of the invention is therefore to provide a microwave cable which avoids the disadvantages of known cables in a simple manner and, in particular, can be assembled without having an adverse effect on the mechanical and electrical properties.

It is also an object of the invention to specify a method for producing a cable of this kind, and also to propose a use.

Therefore, the objective is to indicate an economical solution to the problem of how to make a flexible coaxial cable with integrated fitting insensitive to instability of the insertion loss during bending and twisting. This requires, in addition to optimum electrical parameters in the microwave range, good mechanical flexibility.

These and other objects are achieved by the features of claims 1, 11 and 14.

The microwave cable according to the invention, which is intended for a frequency range of from 0 Hz up to at least a few 10 GHz, comprises a central inner conductor, a dielectric which concentrically surrounds the inner conductor, an outer conductor which concentrically encases the dielectric, and also a sheathing which concentrically encloses the microwave cable on the outside.

Said microwave cable is characterized in that the outer conductor comprises two electrically conductive tapings which are wound one over the other, in that the tapings are each wound in an overlapping manner, and in that the tapings are progressively wound in opposite directions.

According to one refinement of the microwave cable according to the invention, the tapings are wound in opposite directions of rotation.

According to another refinement of the microwave cable according to the invention, a concentric wire mesh is arranged between the outer conductor and the sheathing.

A further refinement of the invention is characterized in that the tapings are each constructed from a metal tape.

In particular, the metal tapes have the same width and the same thickness.

For uses in which a large number of microwave cables have to be inserted in an extremely small space, such as in the case of test set-ups for microprocessors or other large-scale integrated circuits with high clock frequencies for example, a refinement of the invention in which the microwave cable has an outside diameter of a few millimeters, in particular approximately 1.5 mm, the metal tapes each have a width of a few millimeters, in particular approximately 1.5 mm, and the thickness of the metal tapes is in each case a few 1/100 mm, in particular approximately 0.035 mm, is advantageous.

Another refinement of the invention is distinguished in that the metal tapes are composed of the same material.

In particular, the metal tapes are composed of copper and are silver-plated.

According to another refinement of the microwave cable according to the invention, the metal tapes are each wound with an overlap of approximately 45% and with an offset per revolution of approximately 0.8 mm.

Yet another refinement is characterized in that the sheathing is composed of FEP.

The method according to the invention for producing a microwave cable according to the invention comprises the following steps:

- providing an output arrangement comprising the inner conductor which is surrounded by the dielectric, which output arrangement extends by way of a prespecified length between a first cable end and a second cable end;
- applying the first taping by winding a first metal tape around the output arrangement in an overlapping manner, starting at the first cable end and progressing to the second cable end;

applying the second taping by winding a second metal tape around the output arrangement, which is provided with the first taping, in an overlapping manner, starting at the second cable end and progressing to the first cable end; and applying the sheathing to the output arrangement which is provided with the two tapings.

One refinement of the method according to the invention is characterized in that the first taping is applied in a first direction of rotation, and in that the second taping is applied in a second direction of rotation which is opposite to the first direction of rotation.

Another refinement is characterized in that, before the last step, the output arrangement which is provided with the two tapings is encased by a concentric wire mesh.

According to the invention, the microwave cable is used in a connecting cable which has a coaxial connector at each end, wherein the outer conductor of said coaxial connector is electrically conductively connected to the exposed outer conductor of the microwave cable.

According to one refinement, the outer conductors of the coaxial connectors are each soldered to the outer conductor of the microwave cable.

In particular, when, in the microwave cable, a concentric wire mesh is arranged between the outer conductor and the sheathing, the outer conductors of the coaxial connectors are each soldered to the outer conductor of the microwave cable through the wire mesh.

BRIEF DESCRIPTION OF THE DRAWINGS

The invention will be explained in greater detail below with reference to exemplary embodiments in connection with the drawing, in which.

DETAILED DESCRIPTION OF THE INVENTION

Figure 1:
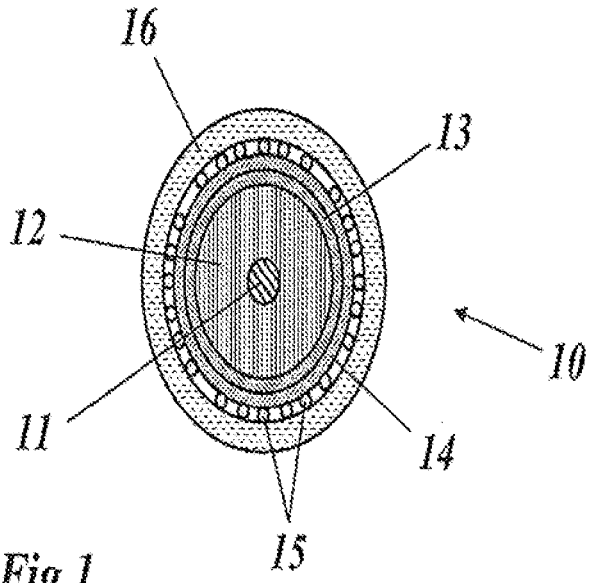
FIG. 1 shows a cross section through a microwave cable according to one exemplary embodiment of the invention.

FIG. 1 shows a cross section through a microwave cable 10 according to one exemplary embodiment of the invention. A central inner conductor 11, which can be composed of a silver-plated Cu wire for example, is arranged in the center of the microwave cable 10. The inner conductor 11 is concentrically surrounded by a dielectric 12 for which the materials which are customary in RF technology, for example PTFE, may be used. The dielectric 12 is concentrically enclosed by a first taping 13 and a second taping 14 in succession in the radial direction, said tapings being discussed in greater detail below. This is followed by a concentric wire mesh 15 which is constructed, for example, from silver-plated Cu wire. Finally, this concentric layer arrangement is enclosed on the outside by a protective sheathing 16 which is preferably composed of an FEP (Fluorinated Ethylene Propylene).

The tapings 13, 14 are each constructed from a metal tape 21, 22 (see FIG. 3). The two metal tapes 21, 22 can be of fundamentally different design in respect of material, thickness and width. However, said metal tapes preferably have the same width B (see FIG. 4) and the same thickness. In particular, the metal tapes 21, 22 are also composed of the same material, preferably of copper, which is silver-plated.

Figure 2:
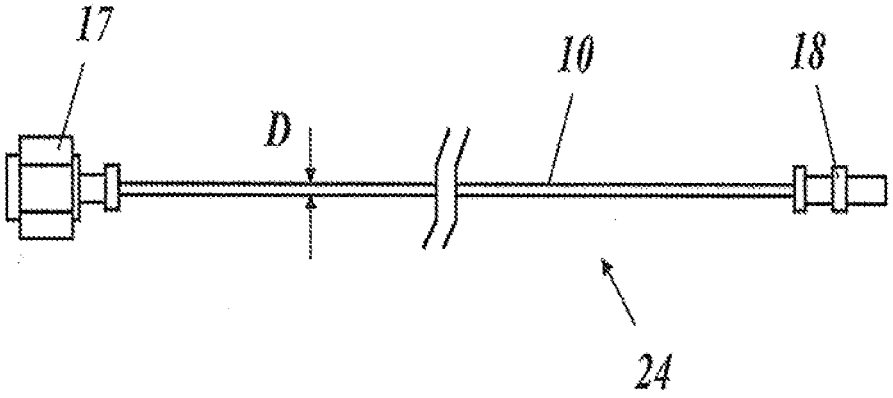
FIG. 2 shows a connecting cable with a microwave cable according to the invention and coaxial connectors which are fitted to the cable ends.

For complex and compact uses, in which the cable has smaller dimensions in particular, the microwave cable 10 can have an outside diameter D (see FIG. 2) of a few millimeters, in particular approximately 1.5 mm. In this case, the metal tapes 21, 22 for the tapings 13 and 14 preferably each have a width B of a few millimeters, in particular approximately 1.5 mm. In this case, the thickness of the metal tapes 21, 22 is in each case a few 1/100 mm, in particular approximately 0.035 mm.

Figure 4:
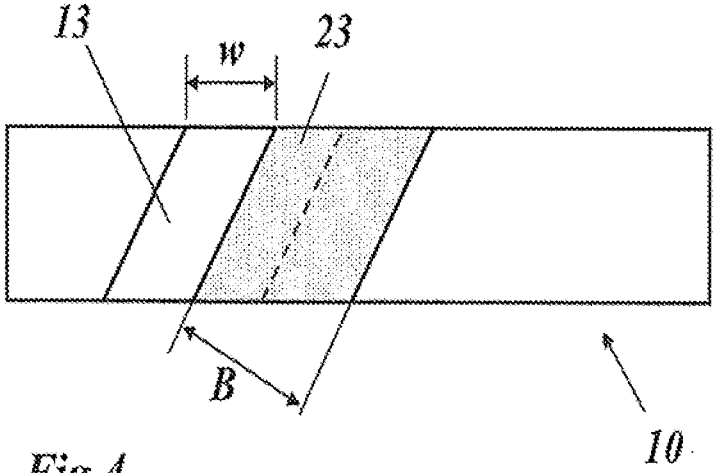
FIG. 4 shows, in a detail, the parameters which are critical for a taping in the case of the microwave cable according to the invention.

In the case of a (miniaturized) microwave cable of this kind, the metal tapes 21, 22 in the tapings 13 and 14 according to FIG. 4 are each wound with an overlap of approximately 45% (overlap region 23) and with an offset per revolution (step width w) of approximately 0.8 mm.

The critical difference from cable forms known to date is, according to the invention, that the tapings 13 and 14 which are wound in an overlapping manner are progressively wound in opposite directions in relation to the cable, as is clear from FIG. 3.

Figure 3A:
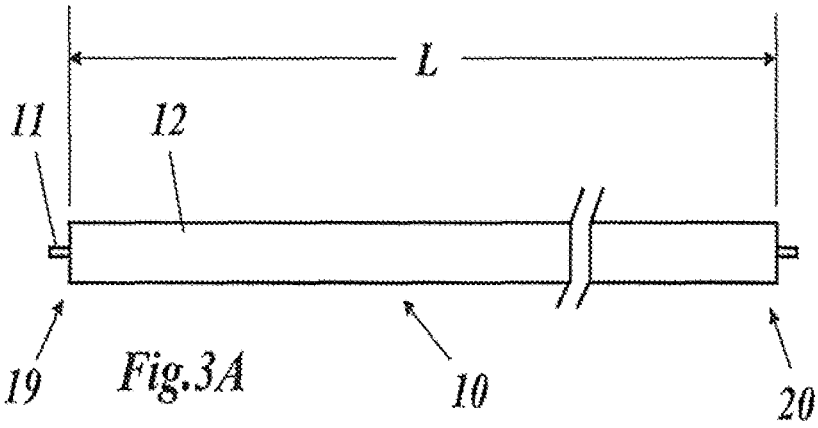
FIGS. 3A-C show various steps when producing a microwave cable according to one exemplary embodiment of the invention.
Figure 3B:
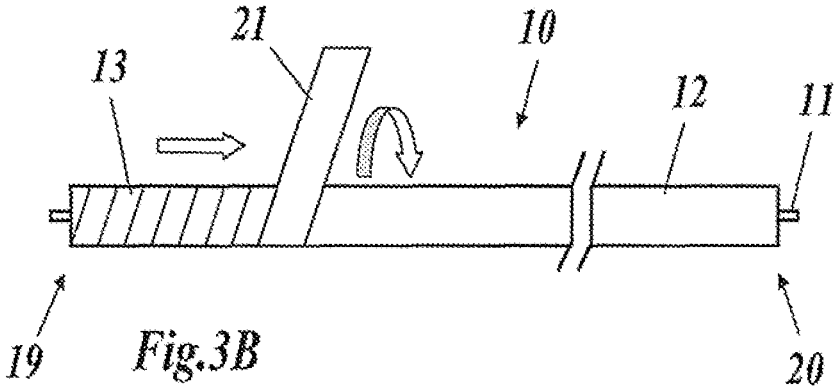
Figure 3C:
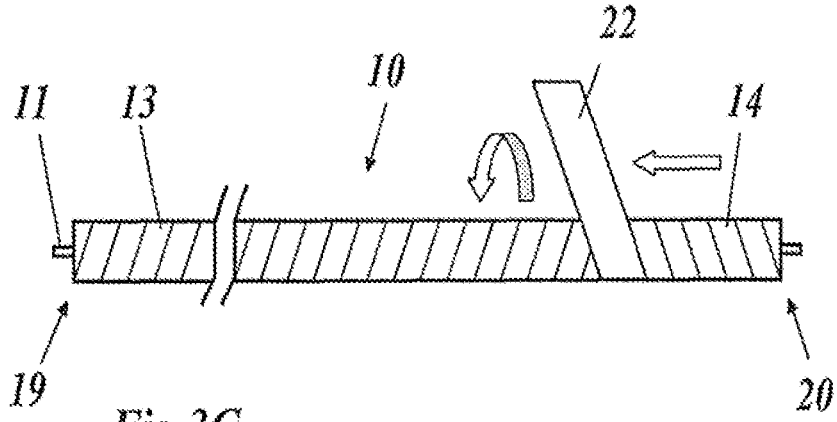

In the method steps illustrated in FIGS. 3A-C, an output arrangement comprising the inner conductor 11, which is surrounded by the dielectric 12, is initially provided (FIG. 3A), said output arrangement extending by way of a predefined length L, which may amount to several kilometers for example, between a first cable end 19 and a second cable end 20;

According to FIG. 3B, the lower first taping 13 is applied to this output arrangement 11, 12 by a first metal tape 21 being wound around the output arrangement 11, 12 in an overlapping manner, starting at the first cable end 19 and progressing (see directional arrows) to the second cable end 20. In the illustrated example, the direction of rotation during winding is counterclockwise as seen in the arrow direction.

If the first taping 13 is fully applied, the second taping 14 is applied according to FIG. 3C by winding a second metal tape 21 around the output arrangement 11, 12 which is provided with the first taping 13, specifically starting at the second cable end 20 and progressing (see directional arrow) to the first cable end 19. In the illustrated example, the direction of rotation during winding is clockwise as seen in the arrow direction.

The microwave cable 10 can then be completed by applying further layers (wire mesh 15, sheathing 16).

In principle, it is feasible to select the direction of rotation to be the same when applying the two tapings. However, the stability of the cable is even greater when the second taping 14 is applied in a direction of rotation which is opposite to the direction of rotation of the first taping 13.

The metal tapes 21, 22 are preferably composed of the same material (silver-plated Cu foil), have the same width B and have the same thickness. When the microwave cable has an outside diameter D of a few millimeters, in particular approximately 1.5 mm, the metal tapes 21, 22 preferably each have a width B of a few millimeters, in particular approximately 1.5 mm. The thickness of said metal tapes is preferably in each case a few 1/100 mm, in particular approximately 0.035 mm.

It has proven expedient in practice to wind the metal tapes 21, 22 in each case with an overlap of approximately 45% and with an offset per revolution of approximately 0.8 mm.

Figure 5:
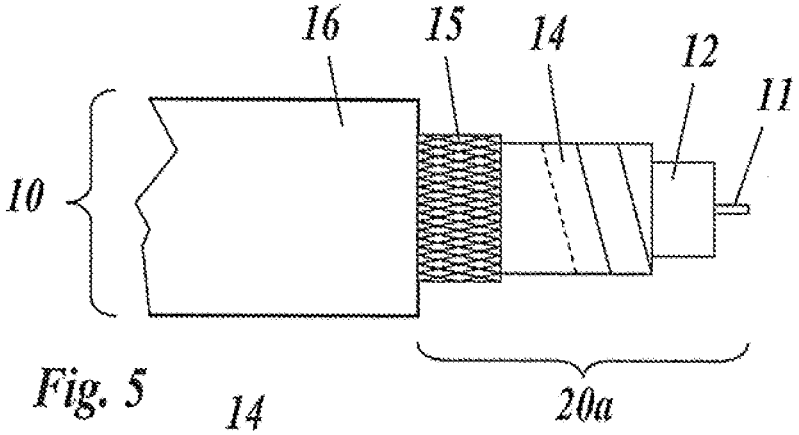
FIG. 5 shows the stabilization effect of the tapings according to the invention when assembling the microwave cable or cutting the microwave cable to length at one end.
Figure 6:
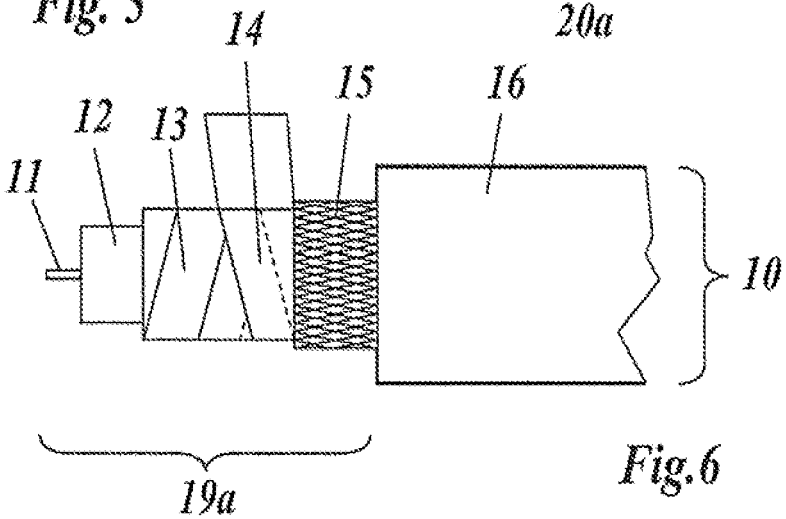
FIG. 6 shows the stabilization effect of the tapings according to the invention when assembling the microwave cable or cutting the microwave cable to length at an opposite end as shown in FIG. 5.

The effect of the double taping in opposite directions during assembly is demonstrated in the illustration in FIGS. 5 and 6: if the microwave cable is cut to length (FIG. 5) and prepared for a coaxial plug connector (for example 18 in FIG. 2) to be fitted at one cable end 20*a*, the second, outer taping 14 is exposed to an extent by shortening the sheathing 16 and the wire mesh 15. However, winding the taping 14 in an overlapping manner (progressively to the left in FIG. 5) effectively prevents the metal tape of the taping 14 from being able to unwind or become detached by itself. However, this also fixes the first taping 13 situated beneath said taping 14 and prevents said first taping from becoming detached at the same time.

If the microwave cable is cut to length (FIG. 6) and prepared for a coaxial plug connector (for example 17 in FIG. 2) to be fitted at the other cable end 19*a*, the second, outer taping 14 is once again exposed to an extent by shortening the sheathing 16 and the wire mesh 15. Although the metal tape of the second taping can unwind in this case because fixing by overlapping is not provided at this end, this is not the case for the first taping 13 which is situated beneath said metal tape of the second taping: in this case, the opposite winding direction produces the same fixing effect by the overlapping as in the case of the taping 14 at the other cable end 20*a*. Since the electrical properties of the cable are determined substantially by the inner first taping 13, it is not important if the taping 14 at the cable end 19*a* becomes detached.

Overall, on account of the specially wound tapings 13 and 14 at the two ends, the microwave cable 10 can be assembled or cut to length and provided with a plug connector without the properties being adversely affected in an undesired manner due to the inner taping 13, which determines the electrical properties, unwinding.

Therefore, the characteristics and advantages of the invention can be summarized as follows:

- The cable outer conductor comprises two, in each case overlapping metal tapes which are not only wound in opposite directions but also have reversed winding directions in comparison to the prior art. Winding of the second taping begins at the cable end of the first taping (wound forward/backward).
- This design provides a lack of sensitivity of insertion loss during bending, and also good protection against radiofrequency radiation. In addition, the requirement for optimum radiofrequency matching between cables and connectors is created: the difference in diameter between the cable insertion means of the plug connector and the outer conductor of the cable (=double tape) can be reduced to a minimum. This allows good insertion and centering of the cable in relation to the connector. This reduces RF reflections (return loss) because deviations in impedance are minimized in this way.
- The tapings (double tape) which are wound in opposite directions and have an opposite winding direction provide advantages during assembly: on account of the overlapping, one winding is always self-fixing at the two cable ends. In the case of the same winding direction or a single tape however, always only one cable end would be self-fixing. Without this self-fixing, the taping comes undone, that is to say the diameter becomes larger, when the cable is cut to length. In this case, it is possible to fit a connector only with the condition that the cable insertion means of the connector has a large enough diameter. However, in this case, centering of the cable in the connector is no longer provided by means of the tape, and this may lead to deviations in impedance and therefore RF reflections. In addition, the larger inside diameter of the undone taping likewise constitutes an electrical RF interference (deviation in impedance), and this leads to RF reflections. The loosened tape can also cause instabilities in insertion loss.
- The double tape also provides substantially more (mechanical) stability than a polymer skin over the tape.
- The double tape which is composed of metal has the advantage of substantially simpler assembly (soldering) in comparison to fixing by means of insulating tape (for example which is composed of Kapton®) when fitting the connector. The two metal tapes are soldered together. However, a Kapton® tape or polymer skin first has to be stripped of insulation in a separate process (manually or by means of laser), so that the metal tape situated beneath said Kapton® tape or polymer skin can be soldered.
- The microwave cable can be used, for example, in cable assemblies for test and measurement purposes, in particular in connection with multiple coaxial connectors as are described in document WO 2009/111895 A1.
- Overall, the invention provides an RF coaxial cable with stringent requirements in respect of stability of insertion loss, optimum RF matching to the connector, economical assembly and very good shielding efficiency.

The invention claimed is:

1. A microwave cable (10) for a broad frequency range comprising:

- a central inner conductor (11);
- a dielectric (12) which concentrically surrounds the inner conductor;
- an outer conductor (13, 14) which concentrically encases the dielectric (12); and
- a sheathing (16) which concentrically encloses the microwave cable (10) on the outside, wherein the outer conductor comprises two electrically conductive tapings (13, 14) which are wound one over the other, and the tapings (13, 14) are each wound in an overlapping manner, wherein the tapings (13, 14) are progressively wound in opposite directions parallel to the longitudinal direction of the microwave cable.

2. The microwave cable as claimed in claim 1, wherein the tapings (13, 14) are wound in opposite directions of rotation.

3. The microwave cable as claimed in claim 1, wherein a concentric wire mesh (15) is arranged between the outer conductor (13, 14) and the sheathing (16).

4. The microwave cable as claimed in claim 1, wherein the tapings (13, 14) are each constructed from a metal tape (21, 22).

5. The microwave cable as claimed in claim 4, wherein the metal tapes (21, 22) have the same width (B) and the same thickness.

6. The microwave cable as claimed in claim 5, wherein the microwave cable (10) has an outside diameter (D) of approximately 1.5 mm, in that the metal tapes (21, 22) each have a width (B) of approximately 1.5 mm, and in that the thickness of the metal tapes (21, 22) is in each case approximately 0.035 mm.

7. The microwave cable as claimed in claim 4, wherein the metal tapes (21, 22) are comprised of the same material.

8. The microwave cable as claimed in claim 7, wherein the metal tapes (21, 22) are copper and are silver-plated.

9. The microwave cable as claimed in claim 6, wherein the metal tapes (21, 22) are each wound with an overlap of approximately 45% and with an offset per revolution of approximately 0.8 mm.

10. The microwave cable as claimed in claim 1, wherein the sheathing (16) comprises FEP (Fluorinated Ethylene Propylene).

11. A method for producing a microwave cable (10) as claimed in claim 1, comprising the following steps:

a) providing an output arrangement (11, 12) comprising the inner conductor (11) which is surrounded by the dielectric (12), which output arrangement (11, 12) extends by way of a prespecified length (L) between a first cable end (19) and a second cable end (20);

b) applying the first taping (13) by winding a first metal tape (21) around the output arrangement (11, 12) in an overlapping manner, starting at the first cable end (19) and progressing to the second cable end (20);

c) applying the second taping (14) by winding a second metal tape (21) around the output arrangement (11, 12), which is provided with the first taping (13), in an overlapping manner, starting at the second cable end (20) and progressing to the first cubic end (19); and d) applying the sheathing (16) to the output arrangement (11, 12) which is provided with the two tapings (13, 14).

12. The method as claimed in claim 11, wherein the first taping (13) is applied in a first direction of rotation, and the second taping (14) is applied in a second direction of rotation which is opposite to the first direction of rotation.

13. The method as claimed in claim 11 wherein, before the last step (d), the output arrangement (11, 12) which is provided with the two tapings (13, 14) is encased by a concentric wire mesh (15).

14. The use of the microwave cable (10) as claimed in claim 1 in a connecting cable (24) which has a coaxial connector (17, 18) at each end, wherein the outer conductor of said coaxial connector is electrically conductively connected to the exposed outer conductor (13, 14) of the microwave cable (10).

15. The use as claimed in claim 14, wherein the outer conductors of the coaxial connectors (17, 18) are each soldered to the outer conductor (13, 14) of the microwave cable (10).

16. The use as claimed in claim 15, wherein, in the microwave cable (10), a concentric wire mesh (15) is arranged between the outer conductor (13, 14) and the sheathing (16), and the outer conductors of the coaxial connectors (17, 18) are each soldered to the outer conductor (13, 14) of the microwave cable (10) through the wire mesh (15).

17. The microwave cable as claimed in claim 1, wherein a first taping of the tapings (13, 14) is progressively wound from a first cable end (19) and progressing to a second cable end (20), and a second taping of the tapings (13, 14) is progressively wound from the second cable end (20) and progressing to the first cable end (19).

18. The microwave cable as claimed in claim 17, wherein the tapings (13, 14) are additionally wound in opposite directions of rotation around the microwave cable.

19. The microwave cable as claimed in claim 1, wherein a winding of one of the two tapings (13, 14) begins at a winding end of the other of the two tapings (13, 14).

* * * * *